US006022254A

United States Patent [19]

Neisen

[11] Patent Number: 6,022,254

[45] Date of Patent: Feb. 8, 2000

[54] EXHAUST SYSTEM FOR INBOARD/ OUTBOARD MARINE PROPULSION SYSTEM

[75] Inventor: Gerald F. Neisen, Oshkosh, Wis.

[73] Assignee: Brunswick Corporation, Lake Forest, Ill.

[21] Appl. No.: 09/089,123

[22] Filed: Jun. 2, 1998

[51] Int. Cl.[7] ..... B63H 21/32

[52] U.S. Cl. ..... 440/89; 181/243

[58] Field of Search ..... 114/285, 286, 114/287; 440/89; 181/235, 241, 243

[56] References Cited

U.S. PATENT DOCUMENTS

| | | | |
|---|---|---|---|
| 3,206,836 | 9/1965 | Schlussler | 440/89 |
| 3,713,841 | 1/1973 | Forbes | 440/89 |
| 5,109,668 | 5/1992 | Lindstedt | 60/310 |
| 5,599,218 | 2/1997 | Schmidt et al. | 440/89 |
| 5,644,914 | 7/1997 | Deavers et al. | 60/310 |
| 5,783,781 | 7/1998 | Mengoli et al. | 181/241 |
| 5,832,726 | 11/1998 | Rees et al. | 181/243 |
| 5,874,292 | 2/1999 | McMinn, Jr. | 435/262 |

*Primary Examiner*—Stephen Avila

*Attorney, Agent, or Firm*—Andrus, Sceales, Starke & Sawall

[57] ABSTRACT

An exhaust system for inboard/outboard marine propulsion system. The exhaust system includes intermediate exhaust pipes which are physically separate components than the water separator. A sealed latching mechanism connects an outlet portion of the intermediate exhaust pipes to an inlet portion of the water separator. The sealed latching mechanism is secure yet flexible, and allows the orientation of the intermediate exhaust pipe to be adjusted relative to the water separator, thus allowing the exhaust system to be installed and serviced without dismounting or loosening the engine. The intermediate exhaust pipes also have a flared inlet part to facilitate alignment of the intermediate exhaust pipe at the exhaust elbow.

14 Claims, 5 Drawing Sheets

EXHAUST SYSTEM FOR INBOARD/ OUTBOARD MARINE PROPULSION SYSTEM

FIELD OF THE INVENTION

The invention relates to exhaust systems for inboard/outboard marine propulsion systems. In particular, it relates to an improved exhaust system that can be installed and serviced without having to remove or loosen the engine.

BACKGROUND OF THE INVENTION

Conventional exhaust systems for inboard/outboard marine propulsion systems direct water-cooled exhaust from an inboard mounted marine engine through the transom and into the outdrive. The water-cooled exhaust passes through the outdrive and exits through the propeller hub into the surrounding water. In an engine with a V-style engine block, the exhaust system usually includes rigid intermediate exhaust elbows and a rigid bullhorn. The bullhorn is a unitary exhaust system component comprising rigid exhaust pipes and an integral water separator. The intermediate exhaust elbows direct water-cooled exhaust gases and spent cooling water from exhaust elbows located on the engine to the bullhorn. The water separator in the bullhorn separates the liquid water from the water-cooled exhaust gases by forcing the liquid to flow into a separated lower passage located underneath a passage for the gases. The water and exhaust gases are then discharged through the transom into the outdrive. The water is expelled through holes in the side of the outdrive. The exhaust gases flow through the outdrive and are discharged through the propeller hub. Other configurations for exhaust systems in inboard/outboard marine propulsion systems are sometimes used. In some of these systems, the exhaust pipes are physically separated from the water separator and the exhaust pipes are bolted onto the water separator.

Conventional exhaust systems for inboard/outboard marine propulsion systems, while providing adequate means for discharging exhaust gases and cooling water, have significant limitations with regard to their installation and maintenance. With conventional exhaust systems, it is usually important to install the exhaust system before the engine is installed. Also, precise installation of both the exhaust system and the engine is required so that exhaust system interconnections are properly matched. Normally, there is almost no room available for adjustment between the exhaust pipe inlets and the engine exhaust elbow outlets after the engine has been installed. Furthermore, when the exhaust pipes need to be repaired, replaced, or serviced, the engine must normally be removed entirely (or at least loosened on the mounting brackets) to allow sufficient access to the intermediate exhaust pipes and bullhorn.

BRIEF SUMMARY OF THE INVENTION

An exhaust system assembly designed in accordance with the invention includes a water separator mounted on the transom, a pair of rigid intermediate exhaust pipes which span between a respective exhaust elbow on the engine and the water separator, and a pair of sealed latching mechanisms which connect the respective rigid intermediate exhaust pipe to the water separator. The water separator and each of the rigid intermediate exhaust pipes are physically separate components, this enables the exhaust system to be installed and serviced after the engine is completely mounted. In addition, the sealed latching mechanisms between the water separator and the intermediate exhaust pipes are designed to accommodate both rotational and lateral displacement of the intermediate exhaust pipe to facilitate proper alignment of the exhaust pipes with the respective exhaust elbow on the engine.

In the preferred embodiment of the invention, the outlet portion of each rigid intermediate exhaust pipe is inserted into an inlet portion of the water separator. An outer circumferential groove is located slightly upstream from the outlet port for the intermediate exhaust pipe. An elastomeric O-ring is located within the groove and seals between the outer surface of the intermediate exhaust pipe and the inner surface of the water separator inlet portion. The outlet portion of the intermediate exhaust pipe also includes an outwardly extending circumferential positioning flange which is located upstream of the O-ring groove. A part of the circumferential positioning flange is formed into a locking tab. The inlet portion of the water separator receives and engages the outlet portion of the intermediate exhaust pipe, using the circumferential positioning flange to properly locate the outlet portion of the intermediate exhaust pipe within the inlet portion of the water separator. Each inlet portion on the water separator includes a catch adjacent the inlet port. The catch has a lip that latches over the locking tab on the intermediate exhaust pipe outlet portion to securely connect the intermediate exhaust pipe and the water separator. To install the intermediate exhaust pipes, the pipe is rotated to a position where the locking tab clears the catch lip, and the outlet portion of the intermediate exhaust pipe is inserted into the inlet portion of the water separator until the water separator inlet port presses against the circumferential positioning flange on the intermediate exhaust pipe. The intermediate exhaust pipe is locked into engagement with the water separator by rotating the intermediate exhaust pipe towards the engine so that the locking tab on the intermediate exhaust pipe is engaged by the catch lip on the water separator. This sealed latching mechanism allows for a variety of orientations for the intermediate exhaust pipe, and thus the rigid intermediate exhaust pipe can be re-orientated to accommodate various relative positions between the respective engine exhaust elbow and the water separator.

A slight clearance is provided between the outside surface of the intermediate exhaust pipe outlet portion and the inside surface of the water separator inlet portion upstream of the O-ring. This clearance allows for the position of the intermediate exhaust pipe inlet portion to be adjusted laterally, while the O-ring seal maintains the integrity of the seal in the sealed latching mechanism.

The intermediate exhaust pipe preferably also has a flared inlet port. The flared inlet port eliminates diversion of the flow of spent cooling water through the exhaust elbow even when the intermediate exhaust pipe is attached in misalignment to the outlet end of the exhaust elbow. The flared inlet port on the intermediate exhaust pipe increases the range of acceptable positions in which the intermediate exhaust pipe can be connected to the exhaust elbow. The intermediate exhaust pipe is preferably connected to the exhaust elbow using a straight bellows or stiff polymeric hose, secured by stainless steel clamps. Because the flared inlet port eliminates diversion of the flow of spent cooling water through the exhaust elbow, hot spots do not form within the intermediate exhaust pipe, thus preventing premature wear even if the intermediate exhaust pipes are slightly misaligned.

It should be apparent to those skilled in the art that the invention as described herein provides an exhaust system for an inboard/outboard marine propulsion system that facilitates installation and maintenance of the exhaust system without removing or loosening the internal combustion engine. Further, the invention provides an exhaust system that allows for adjustment of the orientation of the intermediate exhaust pipe while allowing spent cooling water to flow into the exhaust pipe unimpeded, thus preventing hot spots from forming on the intermediate exhaust pipe which otherwise could cause premature deterioration.

BRIEF DESCRIPTION OF THE SEVERAL VIEWS OF THE DRAWING

Prior Art

Invention

Figure 2:
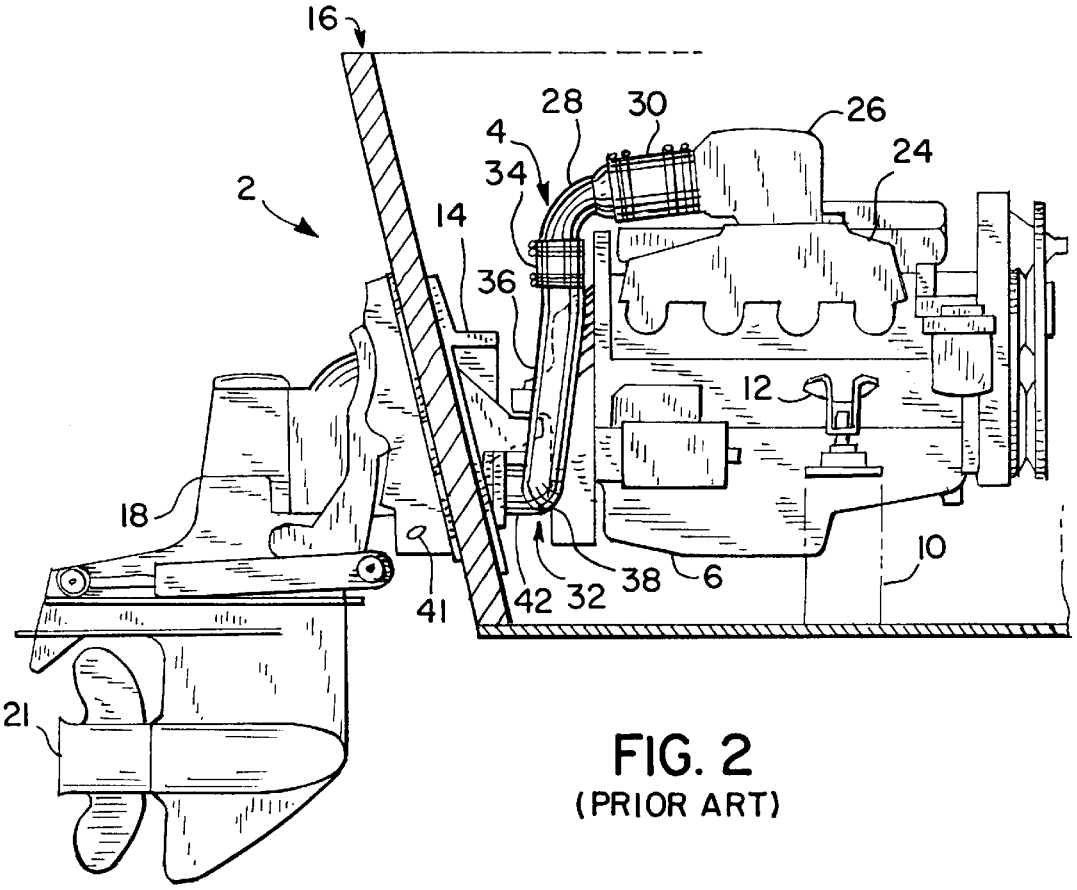
FIG. 2 (PRIOR ART)
FIG. 2 is a side elevational view of the inboard/outboard marine propulsion system and prior art exhaust system shown in FIG. 1.
Figure 4:
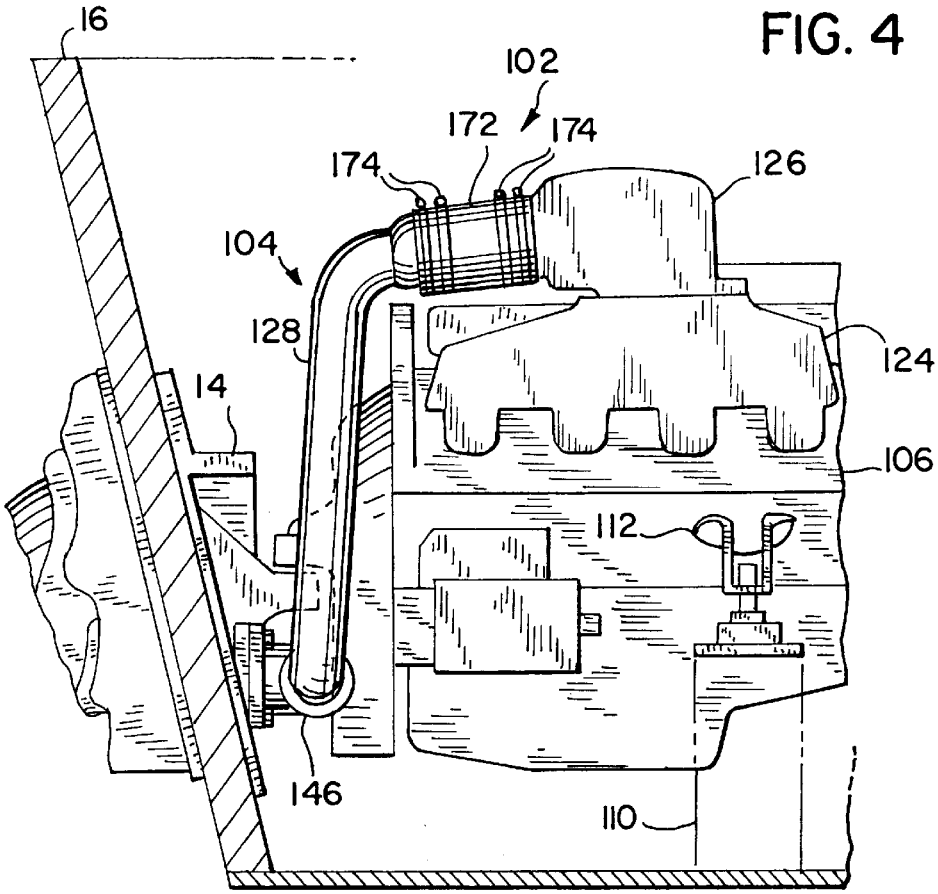

FIG. 4 is a side elevational view similar to FIG. 2 showing an inboard/outboard marine propulsion system having an inboard/outboard internal combustion engine, a transom mounted outdrive and an exhaust system assembly constructed in accordance with the invention.

Figure 5:
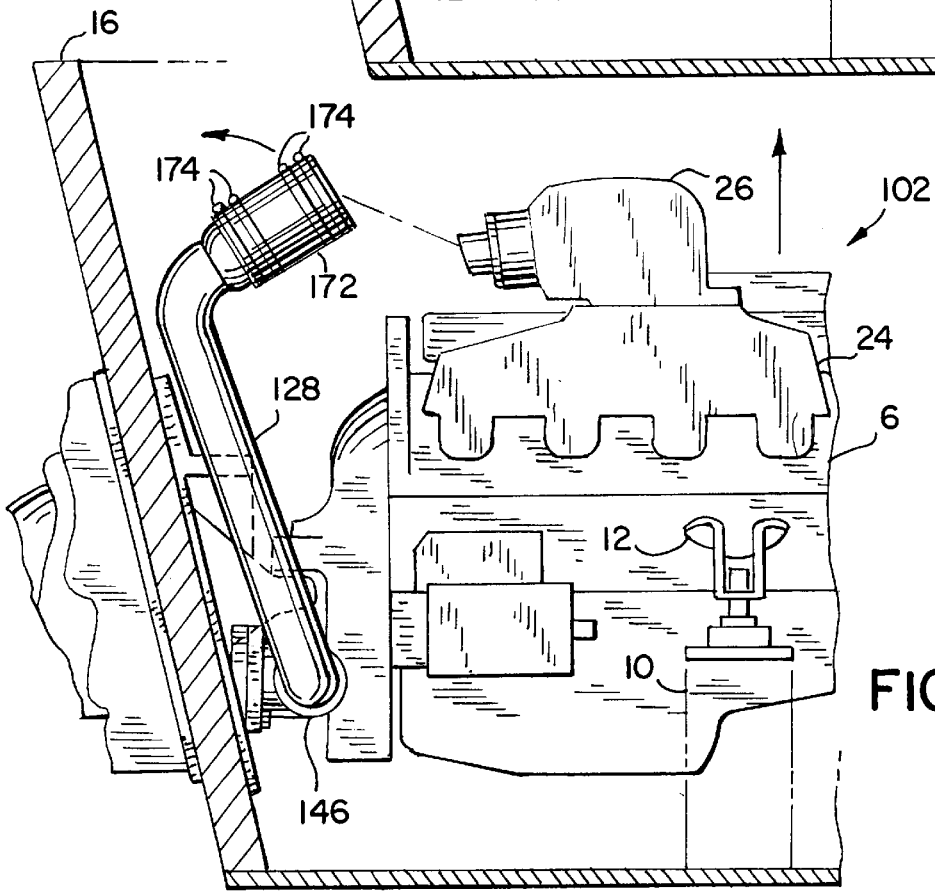

FIG. 5 is a view of FIG. 4 showing an intermediate exhaust pipe rotated rearward to facilitate installation and removal of an exhaust system assembly in accordance with the invention.

Figures 6, 8:
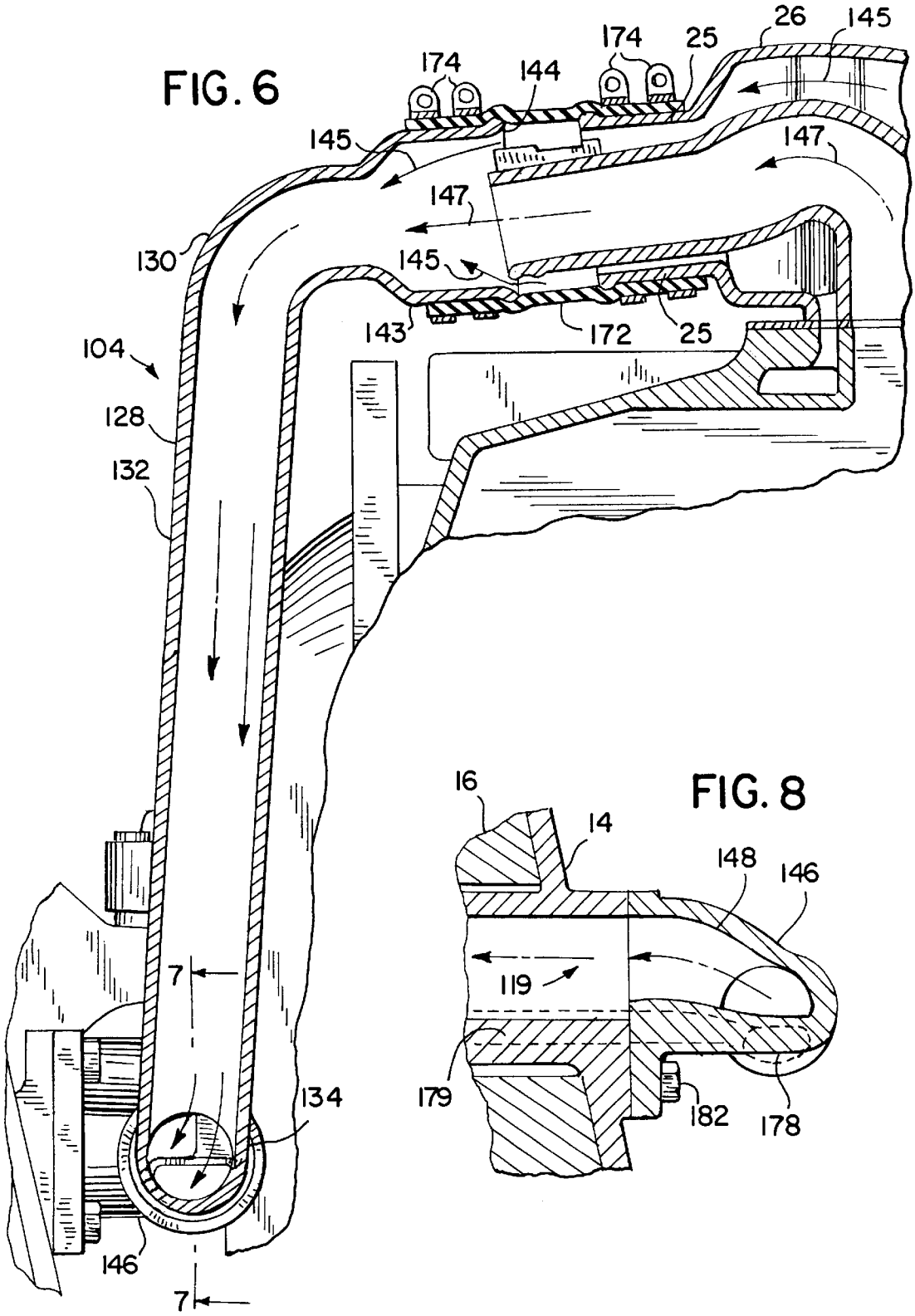

FIG. 6 is a sectional view of the exhaust system assembly shown in FIGS. 4 and 5.

Figure 7:
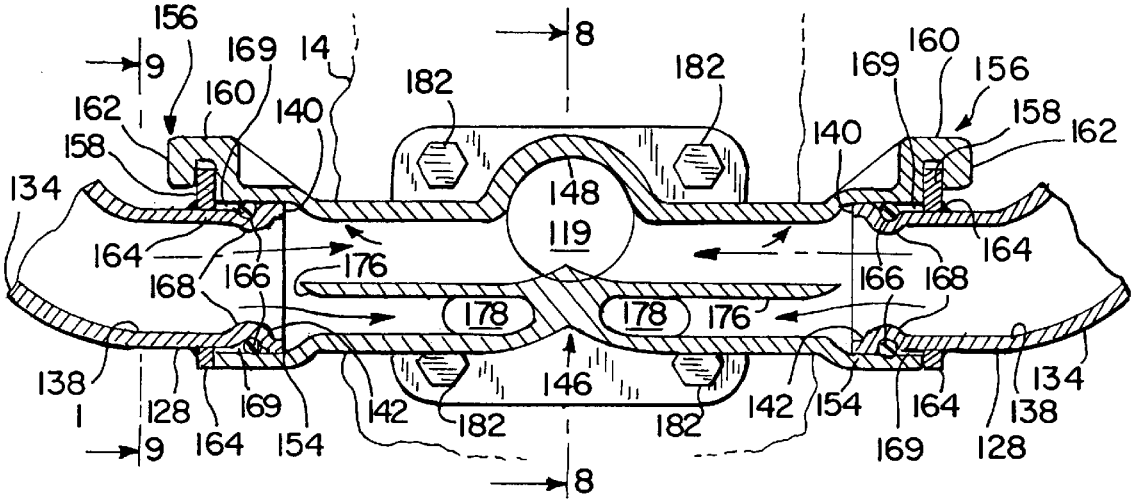

FIG. 7 is a sectional view taken along the line 7—7 in FIG. 6.

FIG. 8 is a sectional view taken along the line 8—8 in FIG. 7.

Figure 9:
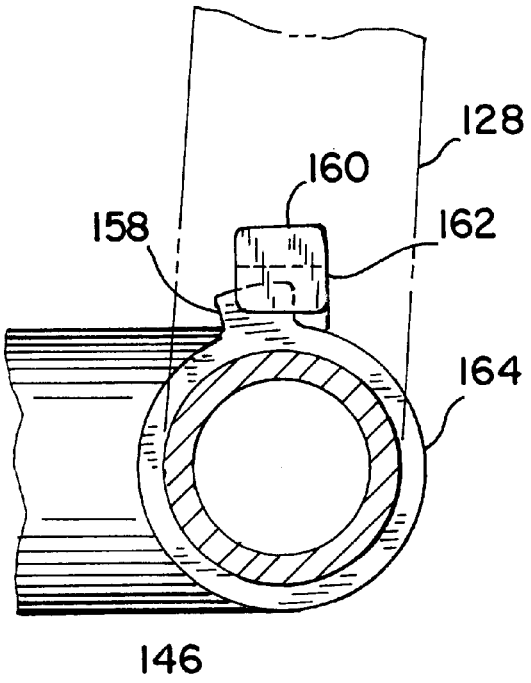

FIG. 9 is a sectional view taken along the line 9—9 in FIG. 7.

Figure 10:
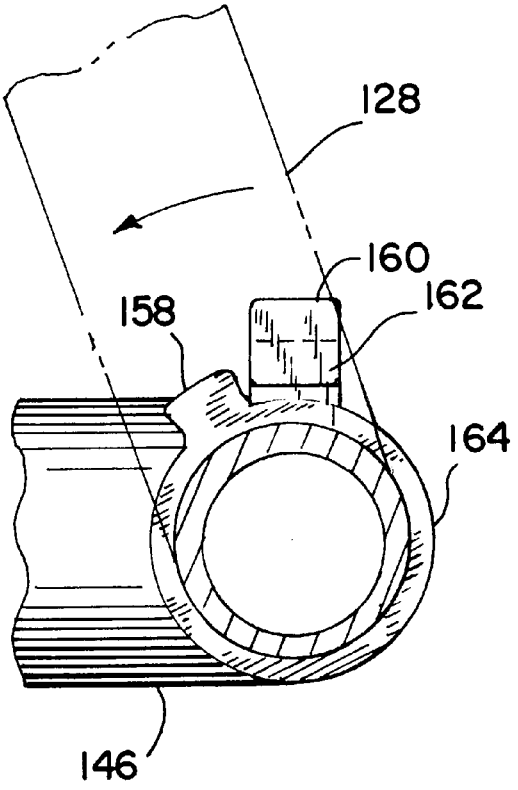

FIG. 10 is a view similar to FIG. 9 showing the intermediate exhaust pipe rotated to the position shown in FIG. 5.

DETAILED DESCRIPTION OF THE INVENTION

Prior Art

FIGS. 1–5 show an inboard/outboard marine propulsion system 2 having an engine exhaust system 4 in accordance with the prior art. An internal combustion engine 6 is mounted inboard boat 8 to joists 10 using mounting brackets 12 located on either side of the engine 6. A gimbal housing 14 is mounted onto the boat transom 16. Rearward of the transom 16, an outdrive 18 is affixed to the transom 16. The outdrive 18 connects to the engine output shaft through a coupling mechanism passing through the transom 16.

The engine 6 has a V-style engine block. Each side of the engine 6 has an exhaust manifold 24. Each exhaust manifold 24 supports a water-jacketed exhaust elbow 26. The exhaust elbows 26 receive hot exhaust from the respective exhaust manifold 24 and spent cooling water from the engine cooling system. Water-cooled exhaust and spent cooling water are discharged from the engine 6 into an exhaust conduit system 4 attached to exhaust elbows 26.

The prior art exhaust conduit system 4 includes a pair of intermediate exhaust pipe elbows 28. The intermediate elbows 28 are rigid. The inlet portion of each intermediate elbow 28 is connected to the respective exhaust elbow 26 by a suitable coupling 30 such as an elastomeric bellows and clamps. The outlet portion of the intermediate elbow 28 is joined to a respective side of a rigid bullhorn 32 by a suitable coupling 34 such as an elastomeric bellows and clamps. The rigid bullhorn 32 is generally U-shaped. It includes a pair of rigid exhaust tubes 36 that are coupled in abutting relationship to the outlet portion of the respective intermediate elbow 28. The rigid exhaust tubes 36 on the bullhorn 32 extend downward and rearward and then bend towards each other (e.g. bend portions 38). The rigid exhaust tubes extend generally horizontal towards each other (i.e., horizontal portions 40). The horizontal portions 40 of the bullhorn join together at a water separator 42 which is an integral component of the bullhorn 32. The water separator 42 is mounted to the gimbal housing 14 as shown in FIG. 2. Water-cooled exhaust gas and spent cooling water are discharged from the water separator 42 into the outdrive 18. The spent cooling water is discharged through holes 41 in the side of the outdrive 18. The outdrive 18 includes an exhaust passageway which directs water-cooled exhaust through the outdrive to be expelled through the propeller hub 21.

Figure 3:
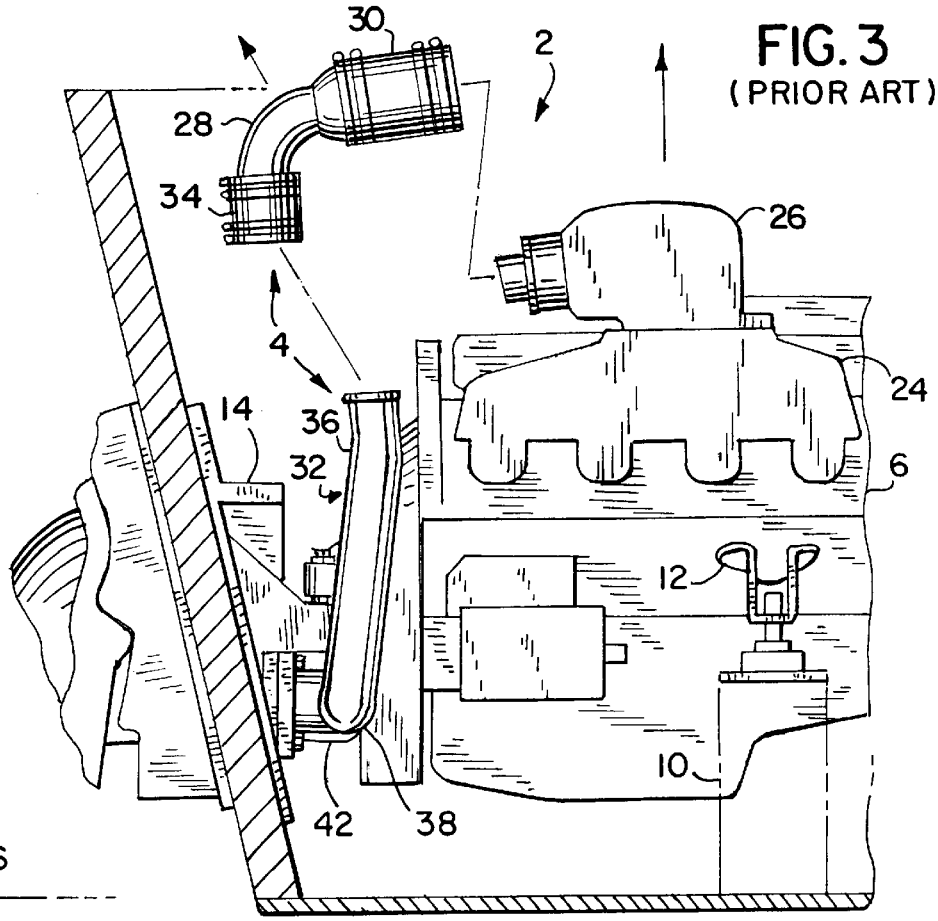
FIG. 3 (PRIOR ART)
FIG. 3 is similar to FIG. 2 in which part of the prior art exhaust assembly is partially removed.

Referring now in particular to FIG. 3, the exhaust conduit system 4 is installed by bolting the rigid bullhorn 32 to the gimbal housing 14. With the engine 6 loosened on mounts 12, the rigid intermediate exhaust elbows 28 along with accompanying bellows 30 and 34 are then put in place between the upper portion of the respective rigid exhaust tube 30 on the bullhorn 32 and the outlet for the respective exhaust elbow 26. The engine mounts 12 are then tightened.

Present Invention

Figure 1:
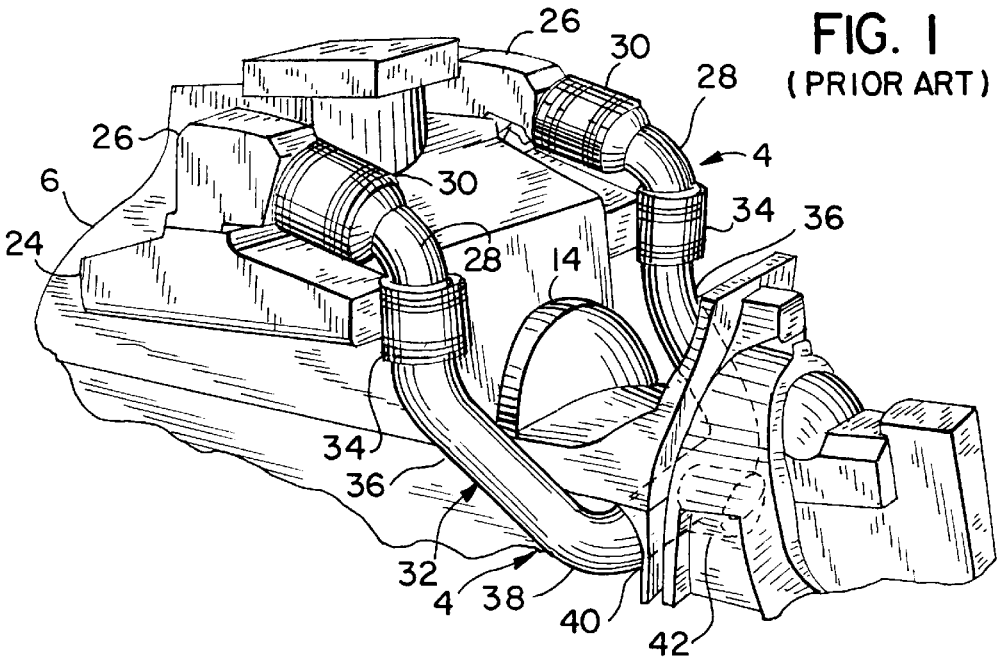
FIG. 1 (PRIOR ART)
FIG. 1 is a perspective view of an inboard/outboard marine propulsion system having an inboard mounted internal combustion engine, a transom mounted outdrive and an exhaust assembly constructed in accordance with the prior art.

FIGS. 4 and 5 show an inboard/outboard marine propulsion system 102 in accordance with the invention. The primary difference between a marine propulsion system 102 in accordance with the invention as shown in FIGS. 4 and 5 and the prior art marine propulsion system 2 shown in FIGS. 1–3 is the exhaust system. FIGS. 6–10 show details of the improved exhaust system in accordance with the invention. Where appropriate, like reference numerals are used to describe the marine propulsion system 102 and the improved exhaust system shown in FIGS. 4–10 as were used in FIGS. 1–3 with respect to the prior art marine propulsion and exhaust systems.

The exhaust system 104 includes a pair of rigid intermediate exhaust pipes 128 and a water separator 146, each made from die cast aluminum. The rigid intermediate exhaust pipes 128 and the water separator 146 are physically separate components. Each rigid intermediate exhaust pipe 128 has an inlet portion 143 with a flared inlet port 144, FIG. 6, that is about 4½ inches in diameter. The purpose of the flare 144 is to accommodate slight misalignment of the intermediate exhaust pipe 128 with the exhaust elbow 26 without causing substantial restriction of cooling water flow (arrows 145) as the cooling water 145 exits the exhaust elbow 26. Hot exhaust gases (arrows 147) are discharged from the central tube of the exhaust elbow 26, and it is important that the inlet port 144 for the intermediate exhaust pipe 122 does not substantially interfere with the flow of spent cooling water 145, otherwise appropriate cooling of the hot exhaust gases 147 may not occur. If the hot exhaust gases 147 are not cooled sufficiently, the intermediate exhaust pipe 128 and possibly other components of the exhaust system may deteriorate prematurely.

The inlet portion 143 and flared inlet port 144 are held in engagement with a water-jacketed exhaust elbow 26 by a bellows 172, preferably made of a stiff, polymeric hose, and stainless steel clamps 174. The bellows 172 holds the flared inlet port 144 and the water-jacketed exhaust elbow 26 together in such a way as to leave about a ½ inch space between the leading edge of the flared inlet port 144 and the trailing edge of the water-jacket 25 for exhaust elbow 26. The bellows 172 is preferably a straight tube.

Each rigid exhaust pipe 128 also includes an upper bend portion 130, a straight middle portion 132, a curved lower bend portion 134, and an outlet portion 138, all of which are about 3½ inches in diameter.

The attachment of lower bend portions 134 of the rigid intermediate exhaust pipes 128 to the water separator 146 is shown in FIG. 7. Water-cooled exhaust discharges from the rigid intermediate exhaust pipes 128 into the water separator 146 through output port 140 of the outlet portions 138 of the respective rigid intermediate exhaust pipes 128. Each outlet portion 138 includes a circumferential groove 168 located slightly upstream of the outlet port 140. An elastomeric O-ring seal 166 is located within the circumferential groove 168 and forms a seal between an inside surface 154 of the water separator 146 inlet portion and the outside surface of the outlet portion 138 of the respective rigid intermediate exhaust pipe 128. Note that downstream of the circumferential groove 168 and the O-ring 166, the outside surface of the outlet portion 138 fits snugly within the inlet portion of the water separator 146. On the other hand, a small clearance 169 is provided between the inlet portion of the water separator 146 and the outlet portion 138 of the respective intermediate exhaust pipe 128 upstream of the circumferential groove 168 and O-ring 166. The primary purpose of the clearance 169 is to allow slight adjustment of the orientation of the rigid intermediate exhaust pipes 128 with respect to the water separator 146. The elastomeric O-ring seal 166 provides an adequate seal even when the orientation of the rigid intermediate exhaust pipe 128 with respect to the water separator 146 is not optimum.

The outlet portion 138 of each rigid intermediate exhaust pipe 128 also includes a circumferential positioning flange 164. The positioning flange 164 extends outward from the outlet portion 134 of the rigid intermediate exhaust pipe 28 and is located upstream of the circumferential groove 168. The circumferential positioning flange 164 abuts the water separator 146 inlet port when the exhaust system is assembled. A locking tab 158 extends radially outward along a portion of the circumferential positioning flange 164.

Referring now in particular to FIGS. 7 and 8, the water separator is mounted to the gimbal housing 14 by bolts 182. The water separator 146 has separator plates 176 that separate the water-cooled exhaust gases from the spent cooling water. The water separator 146 includes an exhaust outlet passage 148, through which the water-cooled exhaust gases are discharged into an exhaust passageway 119 extending through the transom 16 to the outdrive 18. The water separator 146 also includes water discharge channels 178 which discharge spent cooling water into water discharge passageways 179 through the transom 16 into the outdrive 18.

The inlet portions 150 of the water separator 146 each include a catch 160. The catches 160 each include a lip 162 that engages the tab 158 on the intermediate exhaust pipe outlet portion 138 to latch the respective intermediate exhaust pipe 128 to the water separator 146. FIGS. 9 and 10 show that the catch lip 162 engages and disengages the locking tab 158 on the intermediate exhaust pipe 128 by rotating the intermediate exhaust pipe 128 with respect to the water separator 146.

The preferred method of installing the rigid intermediate exhaust pipes 128 is now discussed in reference to FIGS. 4, 5, 7, 9 and 10. The rigid intermediate exhaust pipes 128 are rotated rearward to a position (FIG. 5) where locking tabs 158 clear catches 160. The outlet portions 138 of rigid intermediate exhaust pipes 138 are inserted into the water separator inlet portions 150. The rigid intermediate exhaust pipe outlet portions 138 are inserted into the water separator inlet portions 150 until the circumferential positioning flanges 164 engage the water separator inlet ports 152. In doing so, the outer surfaces 142 of the rigid intermediate exhaust pipe outlet portion 138 downstream of the circumferential groove 168 are in contact with the inner surfaces 15 of the water separator inlet portion. Also, the O-rings 170 located in the circumferential grooves 168 are pressed against the water separator inlet portion surfaces 154, thus forming a water-tight seal for the sealed latching mechanism 156. To lock the rigid intermediate exhaust pipes 128 to the water separator 146, the rigid intermediate exhaust pipes 128 are then rotated forward which moves the locking tabs 158 on the outlet portion 138 of the respective intermediate exhaust pipe 128 into engagement with the appropriate catch 160 on the water separator 146. When the sealed latching mechanisms 156 are fully engaged, the orientation of the intermediate exhaust pipes 128 are adjusted to align the inlet port 144 for the respective intermediate exhaust pipe 128 with the discharge for the appropriate exhaust elbow 26. The inlet portion 143 of the intermediate exhaust pipe 128 is then connected using a bellows and clamps to the exhaust elbow 26 as previously described.

The locking tabs 158 on the intermediate exhaust pipes 128 should have sufficient width to engage the catches 160 on the water separator 146 in a variety of orientations for the rigid intermediate exhaust pipes 128, thus allowing greater flexibility in boat construction when installing the exhaust system. For instance, it is known that typical boat transoms 60 vary in thickness up to ½ of an inch. For this reason, it was often required with prior art exhaust systems to remove and reposition the engine 106 in order to achieve precision installation of the exhaust system. With the invention, however, the orientation of the intermediate exhaust pipes 128 can be easily adjusted to account for such discrepancies in dimensions. Also, as mentioned above, an exhaust system constructed in accordance with the invention allows the exhaust system to be installed and serviced without removing or loosening the engine.

The invention has been described herein in accordance with a preferred embodiment of the invention. It is recognized that various alternatives, modifications and equivalents may be apparent to those skilled in the art. The following claims should be interpreted to cover such alternatives, modifications and equivalents.

I claim:

1. In an inboard/outboard marine propulsion system including an internal combustion engine mounted within a boat and an outdrive mounted to the boat rearward of the transom, an improved exhaust system comprising:

a transom including an exhaust opening through which water-cooled exhaust flows into the outdrive;

a water-jacketed exhaust elbow mounted to the engine that receives engine exhaust from the engine exhaust manifold and also spent cooling water from an engine cooling system, and that discharges water-cooled exhaust gas in a rearward direction towards the transom;

an exhaust system water separator mounted in a fixed position relative to the transom and having an outlet portion that discharges water-cooled exhaust through the exhaust opening in the transom;

a rigid intermediate exhaust pipe having an inlet portion that receives the water-cooled exhaust directly from the water-jacketed exhaust elbow and an outlet portion that is connected to an inlet portion of the water separator;

wherein the connection between the intermediate exhaust pipe outlet portion and the water separator inlet portion comprises a sealed latching mechanism that allows the orientation of the intermediate exhaust pipe to be rotated with respect to the water separator inlet portion, thereby allowing the intermediate exhaust pipe inlet portion to be properly aligned with a cooling water discharge outlet for the exhaust elbow.

2. An inboard/outboard marine propulsion system as in claim 1 wherein the sealed latching mechanism comprises:

a locking tab;

a catch including a lip that engages the tab to latch the intermediate exhaust pipe outlet portion to the water separator inlet portion, wherein the engagement between the lip and the tab has a range of rotation sufficient to account for a variety of mounting configurations for the internal combustion engine within the boat.

3. An inboard/outboard marine propulsion system as in claim 2 wherein the locking tab is located on the intermediate exhaust pipe and the catch is located on the water separator.

4. An inboard/outboard marine propulsion system as in claim 3 wherein the intermediate exhaust pipe further comprises a circumferential positioning flange that extends outward from the intermediate exhaust pipe upstream of an intermediate exhaust pipe outlet port, the circumferential positioning flange engaging a water separator inlet port to maintain the position of the intermediate exhaust pipe when the intermediate exhaust pipe outlet portion is latched to the water separator inlet portion.

5. An inboard/outboard marine propulsion system as in claim 4 wherein the circumferential positioning flange is located at a distance from the intermediate exhaust pipe outlet port that is the same as the distance of the locking tab from the intermediate exhaust pipe outlet port.

6. An inboard/outboard marine propulsion system as in claim 1 wherein the intermediate exhaust pipe outlet portion nests within the water separator inlet portion, an O-ring seal is provided between the water separator inlet portion and the nested intermediate exhaust pipe outlet portion, and latching elements for the sealed latching mechanism are located upstream of the O-ring.

7. An inboard/outboard marine propulsion system as in claim 6 wherein an outside surface of the intermediate exhaust pipe outlet portion fits tightly against an inside surface of the water separator inlet portion downstream of the O-ring and a clearance is provided between the outside surface of the intermediate exhaust pipe outlet portion and the inside surface of the water separator inlet portion upstream of the O-ring, the clearance being sufficient to allow for a variety of mounting configurations for the internal combustion engine within the boat.

8. An inboard/outboard marine propulsion system as in claim 1 wherein the internal combustion engine has a V-style engine block, and the recited engine exhaust manifold is a first engine exhaust manifold, the recited water-jacketed exhaust elbow is a first water-jacketed exhaust elbow, the recited intermediate exhaust pipe is a first intermediate exhaust pipe, the recited water separator inlet portion is a first water separator inlet portion, and the exhaust system further comprises:

a second water-jacketed exhaust elbow mounted to the engine that receives engine exhaust from a second engine exhaust manifold and spent cooling water from an engine cooling system, and that discharges water-cooled exhaust gas in a rearward direction towards the transom;

a second rigid intermediate exhaust pipe having an inlet portion that receives water-cooled exhaust directly from the second water-jacketed exhaust elbow and an outlet portion that is connected to a second inlet portion of the water separator;

wherein the connection between the second outlet portion of the intermediate exhaust pipe and the second inlet portion of the water separator comprises a sealed latching mechanism that allows the orientation of the second intermediate exhaust pipe to be rotated with respect to the second water separator inlet portion, thereby allowing the second intermediate exhaust pipe inlet to be properly aligned with a cooling water discharge port for the second water-jacketed exhaust elbow.

9. An inboard/outboard marine propulsion system as in claim 1 wherein the inlet portion of the intermediate exhaust pipe is connected to the exhaust elbow using a relatively stiff polymeric bellows to circumferentially cover the interface between the intermediate exhaust pipe and the water-jacketed exhaust elbow, the bellows being clamped securely to the water-jacketed exhaust elbow and also clamped securely to the inlet portion of the intermediate exhaust pipe.

10. An inboard/outboard marine propulsion system as in claim 9 wherein the bellows is a straight tube.

11. An inboard/outboard marine propulsion system as in claim 1 wherein the diameter of the inlet portion for the intermediate exhaust pipe flares outward at an inlet port for the rigid intermediate exhaust pipe.

12. In an inboard/outboard marine propulsion system having:

an internal combustion engine mounted at a fixed location within a boat;

an outdrive mounted to the boat rearward of the transom;

the transom including an exhaust opening;

a water-jacketed exhaust elbow mounted to the engine that receives engine exhaust and spent cooling water and that discharges water-cooled exhaust in a rearward direction;

a water separator mounted in a fixed position relative to the transom and having an inlet portion that receives water-cooled exhaust from the engine and an outlet portion that discharges water-cooled exhaust through the transom;

a rigid intermediate exhaust pipe having an inlet portion receiving engine exhaust from the exhaust elbow and an outlet portion connected to the inlet portion of the water separator;

a sealed latching mechanism which connects the outlet portion of the intermediate exhaust pipe to the inlet portion of the water separator, the sealed latching mechanism comprising a locking tab and a catch which can engage each other to latch the intermediate exhaust pipe outlet portion to the water separator inlet portion, the sealed latching mechanism allowing the intermediate exhaust pipe to rotate with respect to the water separator;

a method of installing the intermediate exhaust pipe comprising the steps of:

aligning the outlet portion of the intermediate exhaust pipe with the inlet portion of the water separator;

rotating the intermediate exhaust pipe rearward so that the locking tab clears the catch;

inserting the outlet portion of the intermediate exhaust pipe into the inlet portion of the water separator;

rotating the intermediate exhaust pipe forward to align the inlet port for the intermediate exhaust pipe with a cooling water discharge port for the water-jacketed exhaust elbow and to engage the locking tab and the catch and lock the intermediate exhaust pipe outlet portion inside the water separator inlet portion; and connecting the inlet portion of the intermediate exhaust pipe to the water-jacketed exhaust elbow by clamping a bellows to the intermediate exhaust pipe and water-jacketed exhaust elbow respectively to cover the interface between the intermediate exhaust pipe and water-jacketed exhaust elbow.

13. The method of installing an intermediate exhaust pipe in an inboard/outboard marine propulsion system as recited in claim 12 wherein the inlet port for the intermediate exhaust pipe is positioned so that water flows without restriction from the cooling water discharge port on the water-jacketed exhaust elbow into the inlet port for the intermediate exhaust pipe.

14. A method of installing an intermediate exhaust pipe in an inboard/outboard marine propulsion system as recited in claim 12 further comprising the step of:

moving the inlet port for the intermediate exhaust pipe laterally with respect to the water-jacketed exhaust elbow to align the cooling water discharge port on the water-jacketed exhaust elbow with the inlet port for the intermediate exhaust pipe.

* * * * *